US006312332B1

(12) United States Patent
Walker et al.

(10) Patent No.: US 6,312,332 B1
(45) Date of Patent: Nov. 6, 2001

(54) METHOD AND APPARATUS FOR TEAM PLAY OF SLOT MACHINES

(75) Inventors: Jay S. Walker, Ridgefield; James A. Jorasch, Stamford; Magdalena Mik, Greenwich, all of CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 09/108,827

(22) Filed: Jul. 1, 1998

Related U.S. Application Data

(63) Continuation-in-part of application No. 09/052,835, filed on Mar. 31, 1998, now Pat. No. 6,142,872.

(51) Int. Cl.[7] ..... A63F 9/24

(52) U.S. Cl. ..... 463/23; 463/25; 463/42

(58) Field of Search ..... 463/1, 10–13, 463/16, 20, 25–30, 36, 40–42; 273/138.1, 138.2, 139, 143 R, 292–293, 236–237; 700/91–93; 340/323 R

(56) References Cited

U.S. PATENT DOCUMENTS

| | | | |
|---|---|---|---|
| 4,636,951 | | 1/1987 | Harlick . |
| 4,837,728 | | 6/1989 | Barrie et al. . |
| 4,856,787 | * | 8/1989 | Itkis ..... 273/237 |
| 5,042,818 | | 8/1991 | Weingardt . |
| 5,116,055 | | 5/1992 | Tracy . |
| 5,275,400 | | 1/1994 | Weingardt et al. . |
| 5,280,909 | | 1/1994 | Tracy . |
| 5,324,035 | | 6/1994 | Morris et al. . |
| 5,342,049 | | 8/1994 | Wichinsky et al. . |
| 5,377,973 | | 1/1995 | Jones et al. . |
| 5,409,225 | | 4/1995 | Kelly et al. . |
| 5,472,194 | | 12/1995 | Breeding et al. . |
| 5,482,289 | | 1/1996 | Weingardt . |
| 5,564,700 | | 10/1996 | Celona . |
| 5,580,309 | | 12/1996 | Piechowiak et al. . |
| 5,611,535 | | 3/1997 | Tiberio . |

(List continued on next page.)

OTHER PUBLICATIONS

John Grochowski, "Players Look for Edge with Casino Gimmicks", Chicago Sun–Times, Aug. 25, 1995 at p. 15(2 pages).

"Revealing the Casinos Best–Kept Secrets", Atlantic Insider, Oct. 1996, vol. 1, No. 2, 5 pages.

Bob Rose, "New Ways for the House to Win", St. Louis Post–Dispatch, Oct. 3, 1996 at p. 50(2 pages).

"Triple Play Draw Poker Takes Casino Industry by Storm", IGT Press Release, Feb. 18, 1998, 1 page.

"Author Unknown","Hot Slots & Reel Deals"Atlantic City Insider, Oct. 1996, vol. 1, No. 2.

*Primary Examiner*—Mark Sager
(74) *Attorney, Agent, or Firm*—Dean P. Alderucci

(57) ABSTRACT

A method of operating slot machines permits a machine to be identified as available for team play. Upon being identified for team play, the machine is grouped with other slot machines and subject to bonus conditions dependent on the team play. Bonus conditions typically including selected bonus outcomes and a bonus time period, during which bonus time period all outcomes of the grouped machines are monitored to determine the total bonus outcomes. If the total bonus outcomes of the team meet the bonus conditions within the bonus time period, then a bonus payout is awarded to all of the players. Players are thus encouraged to participate in a social, team environment with others of the team to win the group bonus. The invention is applicable to all slot machines, including video poker machines wherein the bonus outcomes include selected video poker hand ranks, and reeled slot machines wherein the bonus outcomes include selected reel outcomes.

49 Claims, 13 Drawing Sheets

U.S. PATENT DOCUMENTS

| | | | | |
|---|---|---|---|---|
| 5,611,730 | | 3/1997 | Weiss . | |
| 5,639,088 | | 6/1997 | Schneider et al. . | |
| 5,655,961 | | 8/1997 | Acres et al. . | |
| 5,674,128 | | 10/1997 | Holch et al. . | |
| 6,012,982 | * | 1/2000 | Piechowiak | 463/16 |
| 6,077,162 | | 6/2000 | Weiss | 463/26 |

* cited by examiner

BONUS PAYOUT DATABASE 90

| NUMBER OF PLAYERS 94 | BONUS HAND 96 | REQUIRED QUANTITY 97 | TIME LIMIT 98 | PAYOUT 100 |
|---|---|---|---|---|
| 5 | ROYAL FLUSH | 2 | 120 SEC. | 500 |
| 4 | "FOUR OF A KIND" | 3 | 30 SEC. | 25 |
| 5 | FLUSH | 5 | 60 SEC. | 10 |

92A 92B 92C

FIG. 7

TRANSACTION DATABASE 110

| TEAM IDENTIFIER 114 | MACHINE 1 116 | MACHINE 2 118 | MACHINE 3 120 | MACHINE 4 122 | MACHINE 5 124 |
|---|---|---|---|---|---|
| A | 12345 | 23456 | 34567 | OPEN | OPEN |
| B | 45678 | 56789 | 67890 | 78901 | 89012 |
| C | 90123 | 01234 | OPEN | OPEN | OPEN |

112A 112B 112C

FIG. 8

METHOD AND APPARATUS FOR TEAM PLAY OF SLOT MACHINES

The present invention is a continuation-in-part of U.S. patent application Ser. No. 09/052,835 filed Mar. 31, 1998, now U.S. Pat. No. 6,142,872, in the name of Jay S. Walker et al., titled: METHOD AND APPARATUS FOR TEAM PLAY OF SLOT MACHINES, the entirety of which is incorporated herein by reference.

FIELD OF THE INVENTION

The present invention relates generally to slot machines and more particularly to methods and apparatus for enabling team play of slot machines.

BACKGROUND OF THE INVENTION

Casinos constitute a large and increasingly important business in many countries. In the United States alone, casinos constitute a major source of tax income for several states. In those states, the tax income from the casinos is vital to supporting state services such as education.

Modem casinos offer players a wide variety of game alternatives, including table games such as craps, blackjack and poker. Slot machines, however, such as conventional slot machines, video poker, video keno and video blackjack machines, constitute the major source of income for casinos. Casinos therefore constantly strive to increase the attractiveness and playability of slot machines in ways that attract and retain players.

Unlike table games, which often inspire a sense of camaraderie and social interaction amongst players, slot machines tend to be isolationist in nature. There is typically no sense of team play or social interaction associated with a slot machine. Players often feel that they are playing alone against a large, well-funded opponent.

U.S. Pat. No. 5,580,309 to Piechowiak et al. shows a system for selectively enabling a feature, such as an enhanced bonus for a specified winning outcome, on linked slot machines. The feature is enabled based on a predetermined condition, for example the combined results of previous plays on the individual machines, or the passage of a predetermined amount of time. When enabled, the feature is available to the first one of all of the players to generate a winning outcome as defined by the feature. Once a winning outcome has been obtained by one player, the bonus is awarded and the feature is disabled until the future occurrence of another enabling condition.

While Piechowiak et al. shows a system for selectively linking slot machines to provide a common feature, it does not address the problem of the isolationist nature of slot machine play. The Piechowiak et al. system enables the feature for only the period of time necessary for a first player to achieve a win, and does not encourage team play.

In looking for ways for improve the slot machine playing experience, casinos have implemented large jackpots in the form of both fixed jackpots and progressive jackpots amongst linked slot machines. While attracting players, large jackpots do not promote a sense of team play or social interaction. In fact, they may increase the sense of isolation, each player competing to be the one winner of the jackpot. Further, very large jackpots are not typically available on slot machines of the type that have limited ranges of outcomes, such as video poker machines.

U.S. Pat. No. 5,564,700 to Celona shows an exemplary system for providing progressive jackpots for slot machine play. In the Celona system, the progressive jackpot is split amongst multiple players of linked machines who happen to be playing at the time the progressive jackpot outcome occurs on any one of the machines. By splitting the jackpot amongst multiple players, the system extends the basic concept of a progressive jackpot to provide some semblance of group play. However, the group aspect of the game is still quite passive in nature; that is, a player constitutes part of the group only if by happenstance he is playing a linked machine at the time the progressive jackpot occurs. Other than playing the machine in a manner to be eligible for the progressive jackpot, a player can take no particular action alone or as a member of the group to increase the likelihood of winning the progressive jackpot.

U.S. Pat. No. 5,324,035 to Morris et al. shows a video lottery system adapted for competitive play. In contrast to a conventional lottery, wherein a player simply buys an instant or a drawing-based ticket to determine a result, the Morris et al. video lottery is adapted to enable players to buy tickets in a competitive manner. More specifically, lottery pools having known quantities of winning tickets are established, and players are provided both statistical data regarding the number of winning tickets remaining in the pool, and the ability to buy tickets from the pool in a real-time manner. Players may then buy tickets from the pool in a competitive manner, basing the speed and timing of their purchases on their individual strategies of considering the pooled statistical data.

While Morris et al. is representative of one effort to increase the attractiveness of what has been traditionally a game played in isolation, it is quite limited in application. More specifically, it appears to apply only to video lottery. Further, it introduces only the concept of competition, and has no discernible aspect of team play or social interaction.

With respect specifically to video poker, the popularity of these machines has increased significantly over the past years. Many players appreciate that video poker games offer comparatively good odds, and will go to the trouble of studying strategies which increase their chances of winning. Further enhancing the attractiveness of video poker machines could result in substantially increased profitability for casinos. Creating a sense of social interaction and team play could provide such a result.

Previous attempts to link video poker machines, as known to applicants, have not solved the problem of social isolation. One such effort includes the provision of a progressive jackpot, such as Mega-Poker, for video poker players. In Mega-Poker, many video poker machines are linked throughout the state of Nevada, providing a progressive jackpot to the eventual winner. A stand-alone video poker machine, known as "Five Deck Frenzy," uses multiple decks to increase the types of winning hands, thereby allowing for some larger jackpots. As noted above, while having the beneficial effect of attracting players, large and progressive jackpots do not create a sense of team play or social interaction.

An electronic poker table is known wherein up to eight players can play competitively, choosing to draw, fold, or otherwise play using the electronic interface. This, however, is an electronic implementation of the conventional table game, and does not address the issue of improving the player attractiveness of a video poker machine.

In sum, slot machines constitute a significant source of income to casinos. Yet, they may fail to attract a large number of potential players who desire team relationships and social interaction as a necessary part of a casino experience. It would therefore be desirable and beneficial to both the casinos and the players to provide a slot machine that promotes a sense of team play and social interaction. Such a machine could increase profitability to the casino while attracting players not typically drawn to the stand-alone type of play typical of slot machines.

SUMMARY OF THE INVENTION

An object of the present invention is to provide a slot machine conducive to team play and player interaction, whereby to increase the attractiveness of the machine to players.

Yet another object of the invention is to provide video poker machines playable in a cooperative, group manner that encourages team play and some level of interaction amongst the players.

In accordance with one aspect of the invention, there is provided a method and system for operating slot machines, the method comprising the steps of: identifying at least two slot machines for team play, determining a set of bonus conditions for the team play including a bonus payout if the bonus conditions are satisfied by the team play, initiating a bonus time period during which the bonus conditions are active, and analyzing outcomes from the first and second slot machines to determine if the bonus conditions are met during the bonus time period.

In one embodiment of the invention, the bonus conditions further include a requisite number of a specified bonus outcome, the bonus outcomes being totaled between the two machines to determine if the requisite number is met. The bonus time period is initiated upon the occurrence of the first bonus outcome at any of the grouped machines.

When implemented with video poker machines, the bonus conditions include a specified rank of video poker hands. The number and rank of the hands, and the length of the bonus time period, can be selected to provide a desired house advantage. Data describing the progress of the team play can be transmitted for display to each of the team players, thereby encouraging interaction amongst the players and the development of a team spirit.

In accordance with another aspect of the invention, there is provided a method and system for identifying slot machines for team play, the method comprising the steps of: receiving from a first slot machine a signal requesting group play, determining one or more additional slot machines available for group play, and identifying the first slot machine as part of a group including the one or more additional slot machines.

In one embodiment, the signal to request group play is initiated by a player who desires to engage in group play. An embodiment is further provided wherein a player may request the termination of group play.

BRIEF DESCRIPTION OF THE DRAWINGS

These and other objects, features and advantages of the invention will become apparent through a consideration of the detailed description of the invention, in which:

FIG. 7 is a table showing exemplary contents of the bonus payout database of FIG. 4;

FIG. 8 is a table showing exemplary contents of the transaction database of FIG. 3;

DETAILED DESCRIPTION OF THE INVENTION

The present invention provides a method and system for introducing the concepts of team play and social interaction into slot machines through the incorporation of bonus payouts available to a group or team of players if specified bonus conditions are met. In one embodiment, the specified bonus conditions require the team to obtain a requisite number of bonus outcomes within a predefined time period. Bonus outcomes may include, for example ranked hands in video poker (such as a four-of-a-kind or a straight), or reel outcomes in slot machines (such as "cherry-cherry-cherry" or "lemon-lemon-lemon"). The invention thus encourages concerted action by all of the linked players to achieve the bonus outcome.

Figure 1:
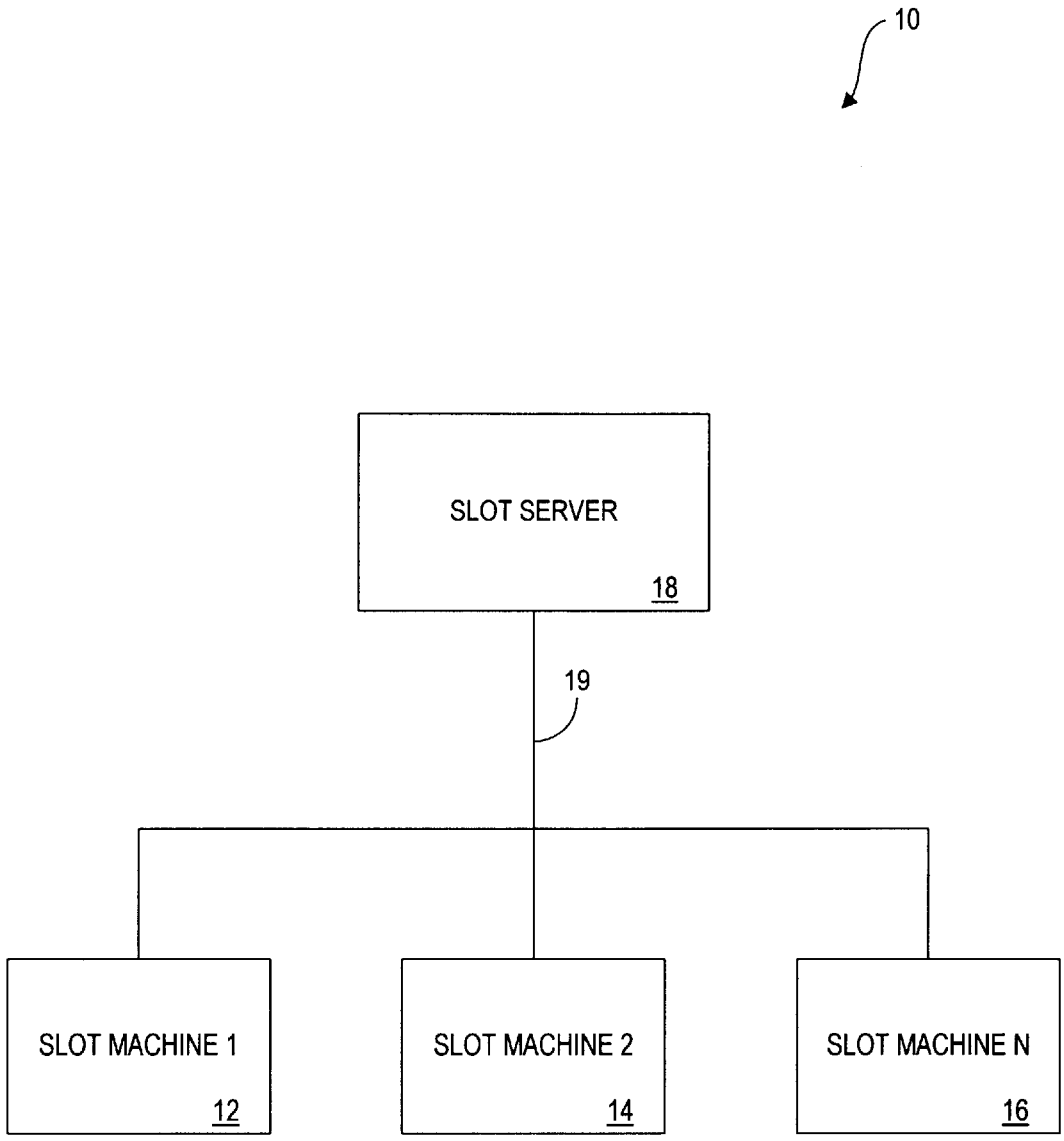
FIG. 1 is a diagrammatic view showing one embodiment of linked slot machines in accordance with the invention.

With reference now to FIG. 1, a system 10 of slot machines 12, 14, 16 is shown, the slot machines connected to a slot server 18 via a communications channel 19.

As used herein, the term "slot machine" is defined to include all electronic gaming devices of the type wherein a paid play results in an outcome used to determine a payout. Such slot machines include, but are not limited to: video poker machines, reel symbol slot machines (mechanical and electrical), video blackjack machines, lottery machines, bingo machines, and keno machines. The invention has particular application to video poker machines, an exemplary one of which is described with respect to FIG. 4 below.

The terms "group" and "team" are used interchangeably herein to identify a plurality of slot machines linked for cooperative play in the manner described below.

Slot server 18 comprises a commercially available computer server, exemplary types of which are described below with respect to FIG. 3.

Communications channel 19 comprises an appropriate data communications system, for example a local or wide area network (LAN and WAN, respectively). According to well known embodiments, communications channel 19 may be wired or wireless in nature. Exemplary wireless systems include cellular radio frequency (RF), and infra-red (IR) systems. In a preferred embodiment, communications channel 19 comprises a wired, local area network.

Figure 2:
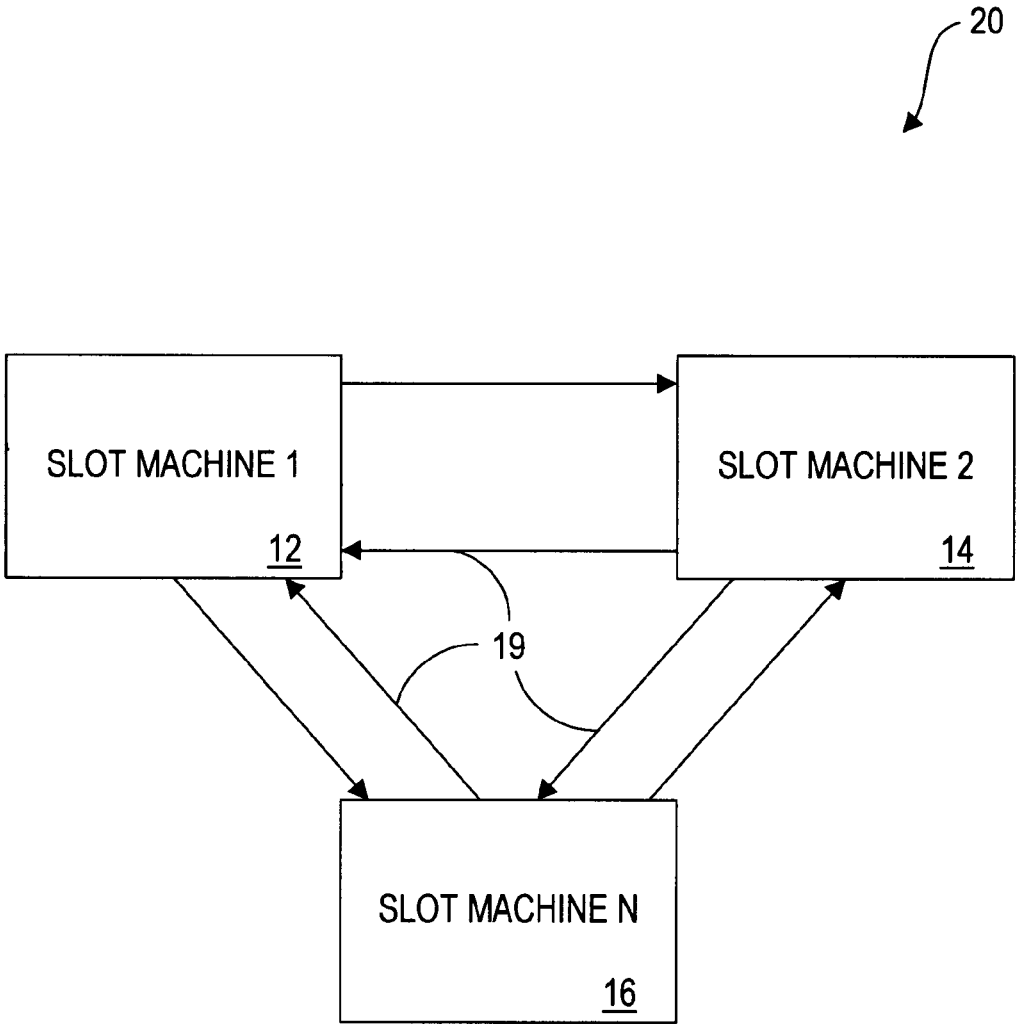
FIG. 2 is a diagrammatic view showing another embodiment of linked slot machines in accordance with the invention.

With reference to FIG. 2, an alternate system 20 of slot machines 12, 14, 16 are shown wherein the slot machines are directly interconnected through communications channel 19 without the use of a slot server. The function of the server (server 18 of FIG. 1) is incorporated into one or more of the slot machines 12, 14, 16. Slot machines 12, 14, and 16 and communications channel 19 are otherwise identical in structure to the like-numbered elements of FIG. 1.

Figure 3:
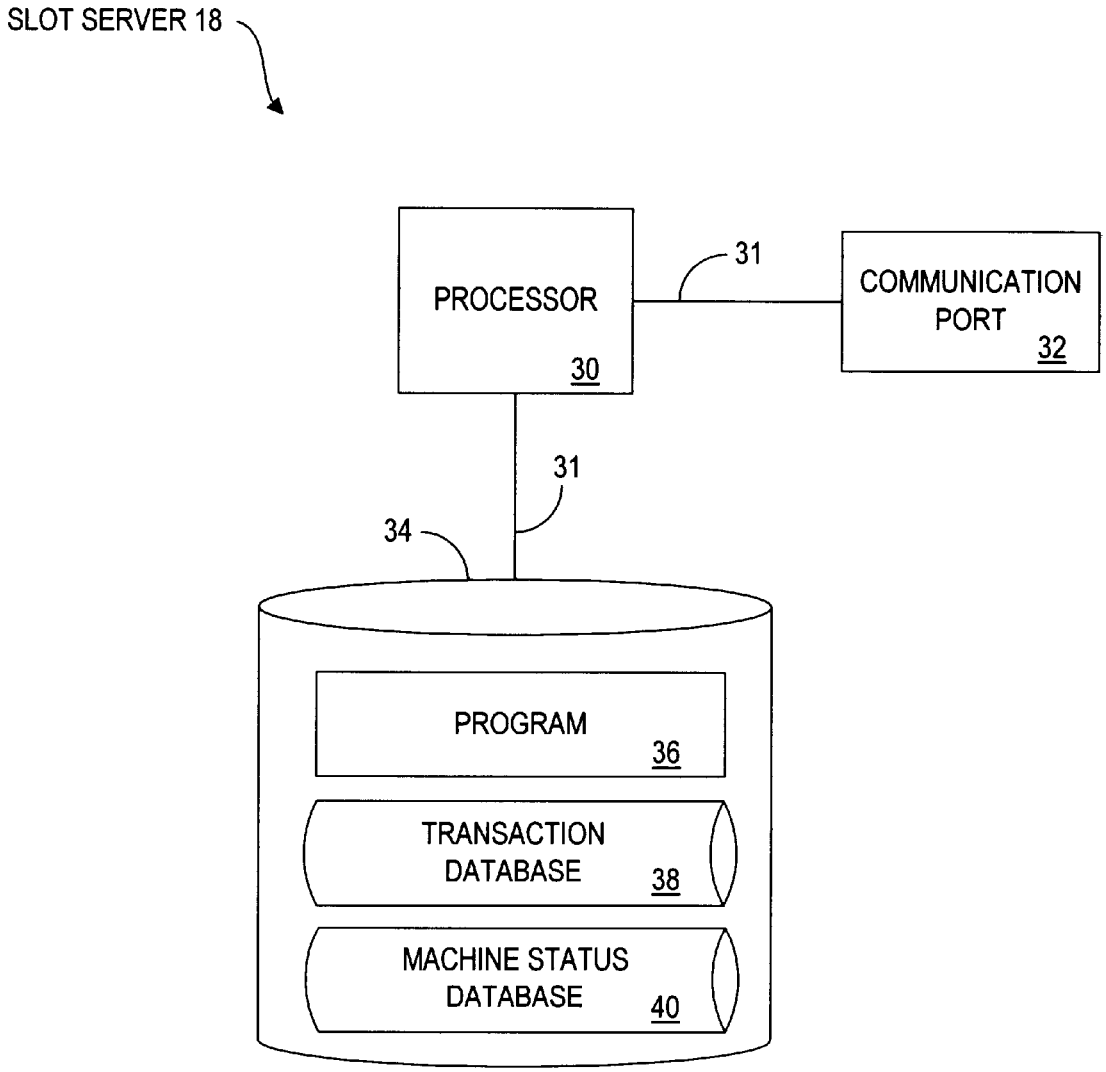
FIG. 3 is a diagrammatic view of the server of FIG. 2.

Referring now to FIG. 3, the basic components of an exemplary slot server 18 are shown to include a processor 30 connected by an appropriate data communications bus 31 to a communications port 32 and a storage device 34. Communications port 32 is selected to be appropriate for the type of communications channel used (communications channel 19 of FIGS. 1 and 2), and in the preferred embodiment would comprise a local area network interface card, many of which are well known in the art.

Storage device 34 comprises an appropriate selection of semiconductor, magnetic and/or optical memory components, many combinations of which are well known in the art. Storage device 34 is seen to contain program code 36 for controlling the operation of slot server 18 in accordance with the processes described below, a transaction database 38 described below with respect to FIG. 8, and a machine status database described below with respect to FIG. 6.

Slot server 18 may comprise one of many commercially known computer systems, for example an IBM AS400™, a DEC Alpha™ server, or the like. Processor 30 and data communications bus 31 would thus comprise appropriate components for the selected system, such system configurations being well known and documented in the art.

Figure 4:
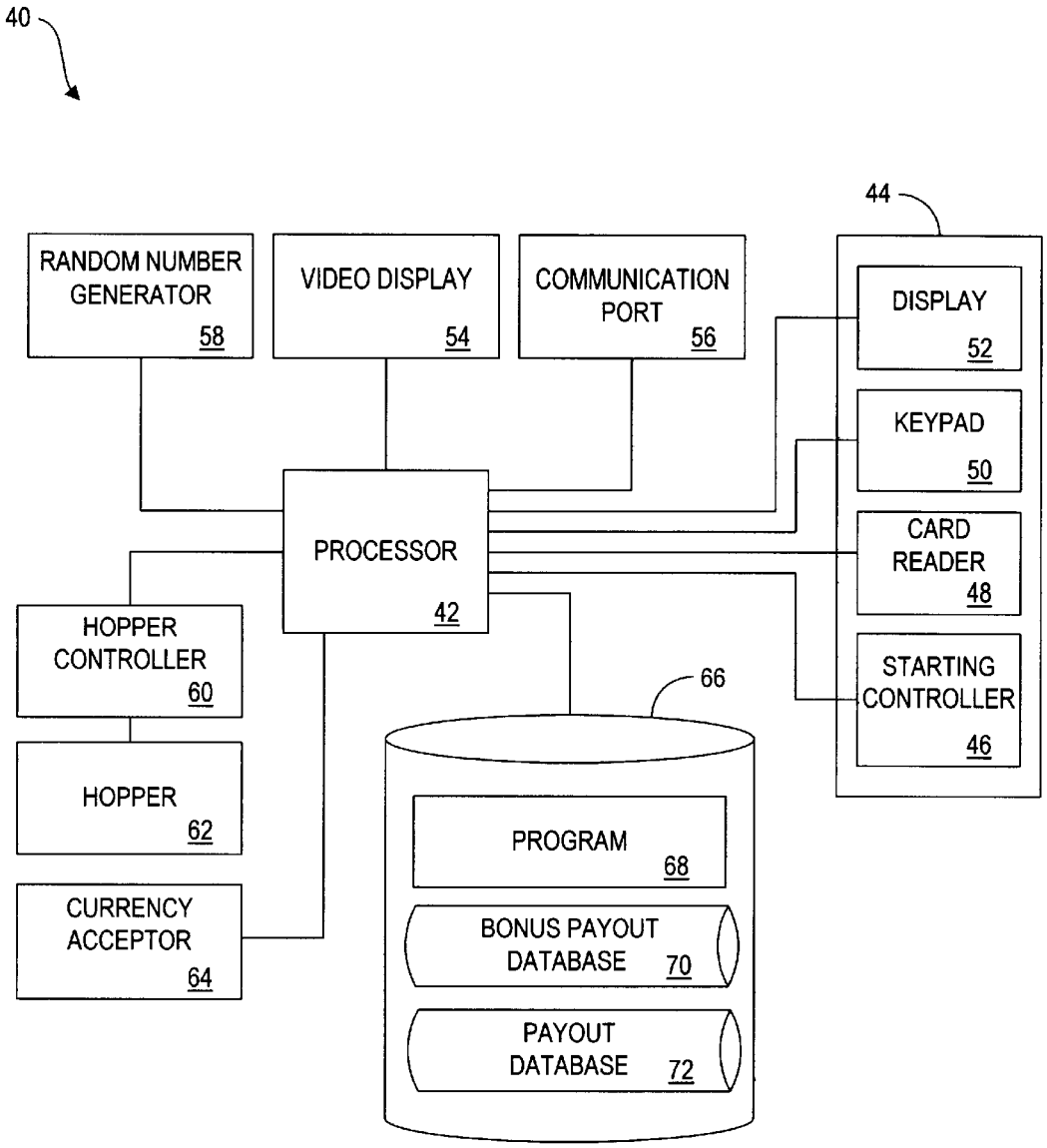
FIG. 4 is a diagrammatic view of a video poker machine in accordance with the present invention.

Referring now to FIG. 4, a block diagram illustrating the key features of a video poker machine 40 is shown. Video poker machine 40, exemplary of an implementation of machines 12, 14, 16 above, comprises a conventional machine with modifications and programming to operate in accordance with the present invention as described herein.

Video poker machine 40 comprises a processor 42 for controlling the operation of the machine, for example an Intel Pentium™ or DEC Alpha™ compatible microprocessor. Processor 42 is connected to an input/output subassembly 44, the subassembly comprising: a starting controller 46, for example a button or lever; a card reader 48 of a conventional type for receiving and reading the data from an encoded player card, for example a magnetically or optically encoded card; an alpha/numeric keypad 50 for receiving player input; and a display 52, for example a light-emitting diode (LED) display for displaying player credits and other player-related information.

Further connected to processor 42 is a video display 54, for example a cathode ray tube (CRT), liquid crystal display (LCD), or LED. Video display 54 is primarily for displaying game results, such as electronic representations of a player's cards. A communications port 56 is connected to processor 42 for connecting video poker machine 40 to data channel 19 (FIGS. 1 and 2 above). A random number generator 58 is connected to the processor for generating a random or a pseudo-random number to determine an outcome and a payout in a manner described below. Alternatively, the function of generating random or pseudo-random numbers can be incorporated into processor 42.

Further connected to processor 42 are a hopper controller 60 for controlling the dispensing of monies, typically in the form of coins, from a hopper 62 into a coin tray (not shown). A currency acceptor 64 is connected for signalling the processor upon the receipt of currency from a player. A storage device 66 comprises an appropriate selection of magnetic, optical, and/or semiconductor storage mediums in many different configurations well known in the art. Contained in storage device 66 is program code 68 for controlling the operation of video poker machine 40 in accordance with the invention as described below, a bonus payout database 70 described with reference to FIG. 7 below, and a payout database 72 which is conventional in the art.

Figure 5:
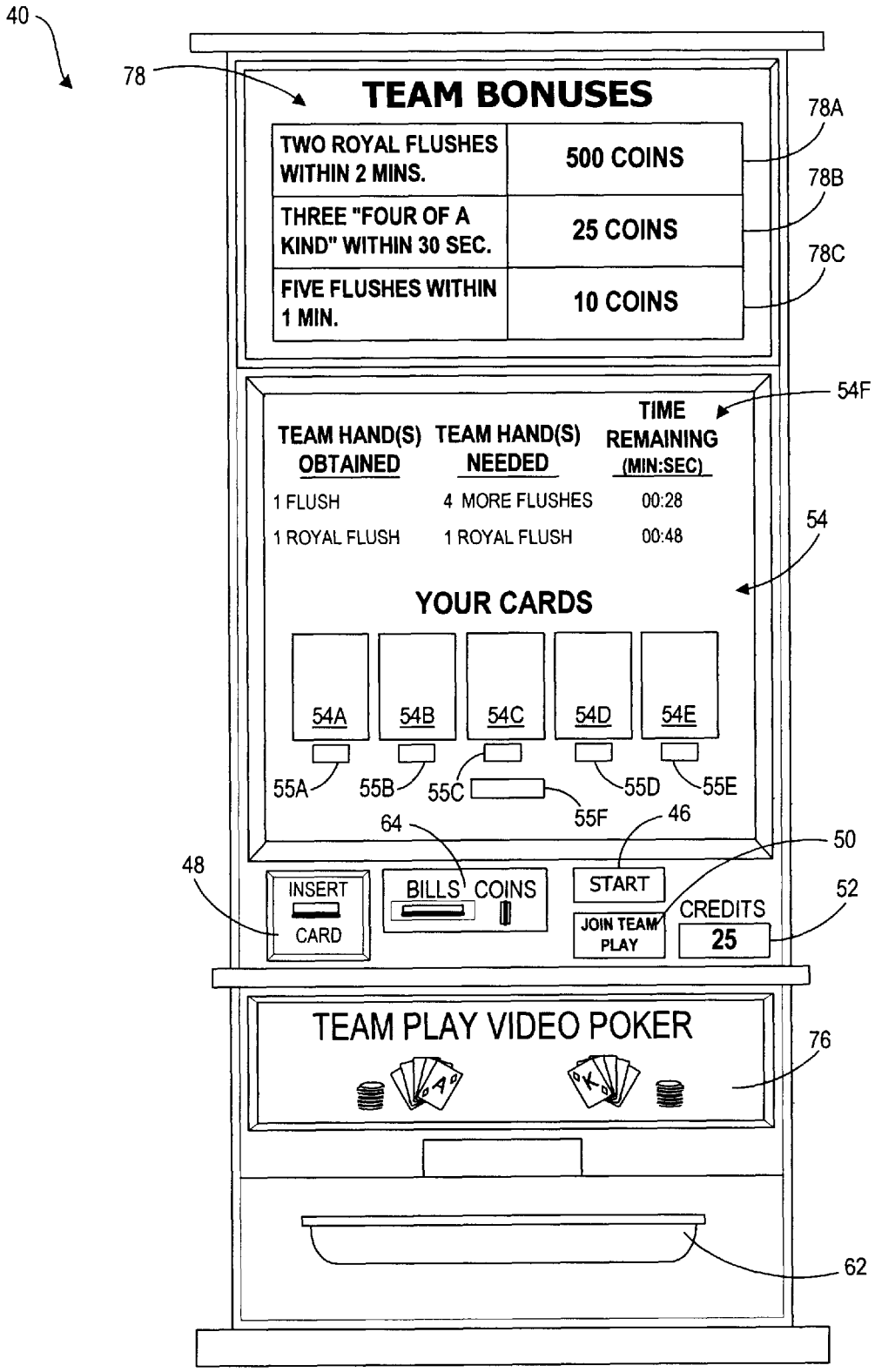
FIG. 5 is a plan view of one implementation of the video poker machine of FIG. 4.

With reference now to FIG. 5 in addition to FIG. 4, a plan view of one exemplary embodiment of video poker machine 40 is shown wherein like elements to FIG. 4 are illustrated by like reference numerals. Starting controller 46 is seen to comprise an electromechanical button labeled "START," while keypad 50 is seen to comprise a single key, labeled "JOIN TEAM PLAY," which when activated enables a player to input a signal indicating a desire to enter into group play.

Additional elements visible in FIG. 5 include a decorative machine logo 76 identifying video poker machine 40 as a "TEAM PLAY VIDEO POKER" machine, and a team bonus display 78 indicating team play bonus conditions. Team bonus display 78 may comprise a changeable electronic display, or a more permanent display, such as painted glass. As is described in further detail below, a player of video poker machine 40 is eligible to win a team play bonus when the machine is engaged in a team play session, and when pre-selected bonus conditions occur during a bonus time period.

Visible in team bonus display 78 are three sets of bonus conditions 78A, 78B, 78C. Bonus conditions 78A indicate that when two royal flushes are obtained in total by the team players within two minutes of the initiation of a bonus time period, a bonus of five hundred coins is paid to the player of video poker machine 40. Bonus conditions 78B indicate that when three four-of-a-kinds are obtained in total by the team players within thirty seconds of the initiation of a bonus time period, a bonus of twenty five coins is paid to the player of video poker machine 40. Bonus conditions 78C indicate that when five flushes are obtained in total by the team players within one minute of the initiation of a bonus time period, ten coins are awarded to the player of video poker machine 40. The various bonus time periods are initiated when the first hand that satisfies a bonus outcome, for example a royal flush per the bonus conditions of record 78A, is obtained by one of the team players.

In one embodiment of the invention, as is discussed in further detail below, the bonus conditions change as the number of players on the team changes. The changed bonus conditions are appropriately displayed on the various grouped machines, for example on bonus display 78, as machines are added to or removed from the team.

It will be understood that a bonus payout as described above is in addition to any other payout(s) earned by a player. In the described embodiment of the invention, the bonus payout is the same for each team player. In alternate embodiments of the invention, the bonus payouts may vary amongst the players, for example favoring one or more players who contribute the most to achieving the bonus conditions with a higher payout.

Examining the content of video display 54, there is shown an exemplary display of a team play session. Five locations 54A–E are marked for displaying the results of a video poker hand, i.e. a five card final hand. Five touch-screen buttons 55A–E are provided for use by a player to indicate which cards are to be kept and which cards are to be discarded. A sixth touch-screen button 55F is provided for receiving an input from the player to initiate a deal. As is understood in the art, a final video poker hand comprises the dealt cards, typically five in number, adjusted by the number of new cards dealt to replace cards not held. The illustrated display includes team play information set out in table form in bonus display area 54F indicating that a bonus time period is underway. As illustrated, one flush has been obtained during a bonus time period, with four more flushes necessary within a remaining time of twenty-eight bonus time period seconds to obtain the five flush bonus payout. Additionally, one royal flush has similarly been obtained amongst the team players during another bonus time period, with one more royal flush necessary within a remaining time of forty-eight bonus time period seconds to obtain the two royal flush bonus payout.

Describing the basic operation of video poker machine 40, a player optionally enters his personal, encoded playing card (not shown) into reader 48, whereby he is identified through communications channel 19 to slot server 18. As described above, in an alternate embodiment of the invention the function of slot server 18 is distributed in one or more of the network linked video poker machines. The player enters money into currency acceptor 64 in the form of bills and/or coins, and obtains a number of credits for game plays. This number of credits, typically a multiple of coinage such as quarters, is based on the amount of money entered and the cost per play, and is displayed on display 52.

In one embodiment of the invention, the player indicates that he wishes to participate in group play by pressing "JOIN TEAM PLAY" button 50. Machine 40 is then ad hoc linked, in a manner described in detail below, to other video poker machines for team play. In this embodiment, the player may choose not to engage in team play, and so may engage the same machine in stand-alone play.

In another embodiment, machine 40 is preset for team play. This status is displayed to passersby, for example through an appropriate message on team bonus display 78, such as "THIS IS A TEAM PLAY MACHINE CONNECTED FOR AUTO-PLAY WITH THE BLUE TEAM." Players who use the machine are automatically linked to the other, predetermined team machines for team play.

Returning now to the description of the ad hoc embodiment, subsequent to engaging in team play, the player presses the starting controller 46 to initiate a play. His credits are then debited by the cost of one play. A random or pseudo-random number is obtained from random number generator 58, which is used in a conventional manner to select and display cards in display area 54A–E. Again in a conventional manner, the player may interact with the machine, typically by pressing buttons 55A–E, to indicate which cards he is holding, and which cards he is discarding for a draw.

Using one of many processes well known in the art, video poker machine 40 operates to select and display drawn cards. Such processes can include, for example, using cards identified based on the first random number to fill the draw, or selecting a new random/pseudo-random number to identify fill cards. The resulting final hand is used to access a payout from payout database 72. The player's winnings, if any, are reflected in the credits shown in display 52.

In accordance with the present invention, if a particular final poker hand (i.e. the hand resulting from the draw) results in a bonus condition, in this case a royal flush, a four-of-a-kind, or a standard flush, video poker machine 40 initiates a bonus mode of operation. As will be described in further detail below, a bonus time period is initiated, and an announcement of the bonus mode is made to the linked, team machines through transmission of data via communication channel 19 and display of bonus information in bonus display area 54F. Team players then play cooperatively to win a bonus by operating their machines using strategies selected to achieve the requisite number of bonus hands required to win the team bonus.

Figure 6:
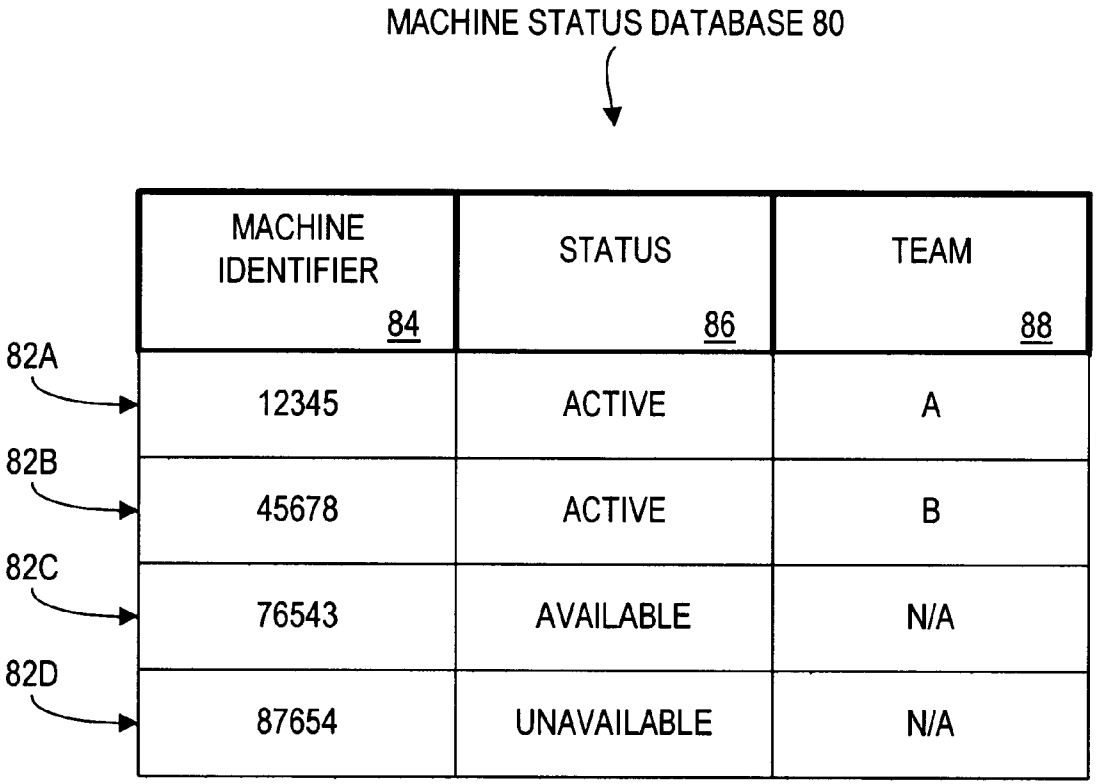
FIG. 6 is a table showing exemplary contents of the machine status database of FIG. 3.

Referring now to FIG. 6, there is shown a table illustrating exemplary contents of machine status database 80. Machine status database 80 is seen to include four records 82A–D, each record including three fields: a machine identifier field 84 containing a code identifying a video poker machine, a status field 86 indicating the play status of the identified machine as "available" for team play, currently "active" in another team and thus unavailable for team play, or "unavailable," i.e. the machine is not currently in play or is in play by a player who has not selected team play, and is thus unavailable for team play, and a team field 88 identifying the team for those machines active in team play. Machine status database 80 may optionally be omitted from the embodiment of the invention wherein team machines are pre-linked, with the status of the machines associated with a particular team being maintained in the transaction database described below.

Referring now to FIG. 7, there is shown a table illustrating exemplary contents of bonus payout database 90. Bonus payout database 90 is seen to include three records 92A–C, each record illustrating an exemplary set of bonus conditions that need to be satisfied in order to earn a bonus payout amount. Each record includes five fields: a number of players field 94 identifying a number of players necessary to satisfy a bonus payout condition, a bonus hand field 96 indicating a bonus outcome—in the present embodiment a required rank of poker hand—necessary to satisfy the bonus payout condition, a required quantity field 97 indicating the required number of ranked hands necessary to satisfy the bonus payout condition, a time limit field 98 indicating a bonus time period within which the team players must obtain the required number of ranked hands to satisfy the bonus payout condition, and a payout field 100 indicating the amount of the bonus payout if the set of bonus conditions in a given record is satisfied.

Examining, for example, record 92A of bonus payout database 90, a set of bonus conditions are seen to include the requirement that, amongst five players, one additional royal flush must be obtained within a one hundred and twenty second time window following the occurrence of a first royal flush on one of the linked team machines, for a total of two royal flushes. If the bonus conditions are met, the player receives a bonus payout of five hundred coins. Records 92B and 92C indicate similar information for other bonus opportunities. The bonus conditions contained in records 92A, 92B, 92C are seen to correspond to those displayed in machine display areas 78A, 78B, 78C, respectively.

In another embodiment of the invention, the number of players defined in field 94 comprises a range of players, for example five-to-ten players, for a given set of bonus conditions. With such a range of players defined, a subset of players may enter into and drop from group play without any change in the bonus conditions for the ongoing players.

In the illustrated embodiment of the invention, each player on a team receives the same bonus payout if the bonus conditions are met during team play. In other embodiments of the invention, the bonus payout is biased to provide a larger payout to a selected one of the team players. In one such embodiment, a player receiving the hand that initiates the bonus play conditions receives a higher bonus payout than the other team players if the bonus conditions are fulfilled. In another such embodiment, a single player who obtains a majority of the hands necessary to fulfill the bonus conditions receives a higher bonus payout than the other players. In yet another such embodiment, a single player who obtains all of the hands necessary to fulfill the bonus conditions receives a higher bonus payout than the other players, or under such circumstances may receive the only bonus payout resulting from meeting the bonus conditions.

It will be appreciated that many combinations of outcomes, time periods, and payouts may be selected. Such combinations are selected in a straight-forward manner dependent on the likelihood of the outcomes while maintaining a desired house (i.e. casino) advantage. As is well known to those skilled in the art, slot machines are operated at a house advantage, typically as selected by the casino and approved by a state regulatory agency, sufficient to provide the casino a profit from the operation of the machines.

In the illustrated embodiment of the invention, different sets of bonus conditions are provided for different numbers of linked, team play machines, i.e. four machines (conditions 92B) or five machines (conditions 92A, 92C). It will be understood by those skilled in the art that numerous other bonus conditions may be provided to facilitate play by teams of many different sizes. Such bonus conditions are selected, according to well known principles, to motivate team play while maintaining an appropriate house advantage. Preferably, the bonus conditions active for a given number of players are transmitted to video poker machine 40 for display in display area 78 (FIG. 5).

In yet another embodiment of the invention, features are provided whereby one or more players may purchase an extension(s) of the bonus period time for themselves and/or for the group. Players may be provided, for example, the option to buy more bonus play time for one dollar per player per bonus minute. The number of players electing to continue bonus play would affect the payout in the manner described above.

Referring now to FIG. 8, a table illustrating exemplary contents of transaction database 110 is shown, the database including information indicating which machines are currently linked for team play. The transaction database is seen to include three records 112A, 112B, 112C, each record including six fields: a team identifier 114 identifying a specific team; and entries for identifying up to five machines 116, 118, 120, 122, 124 currently part of the team. It will be understood that while the invention has been illustrated with up to five machines per team, any number of machines greater than one may be selected. Unfilled machine slots in any particular team record are indicated as "open."

In the illustrated embodiment of the invention, machines are added and/or removed from team play on an ad hoc basis by the players, such status similarly being reflected in machine status database 80 and transaction database 110. In the alternate embodiment wherein machines are pre-linked for team play, the machines enabled for team play are set and left in team play mode for an extended period of time, their identifiers thus being added to transaction database 110 for that extended period of time. In this alternate embodiment, a machine that is pre-linked but not currently in play would be identified in transaction database 110, for example, with an entry of "machine identifier/out of play." The "out of play" indicator would be deleted when the machine was engaged in play. Bonus conditions would be adjusted based on the number of active team players.

Figure 9:
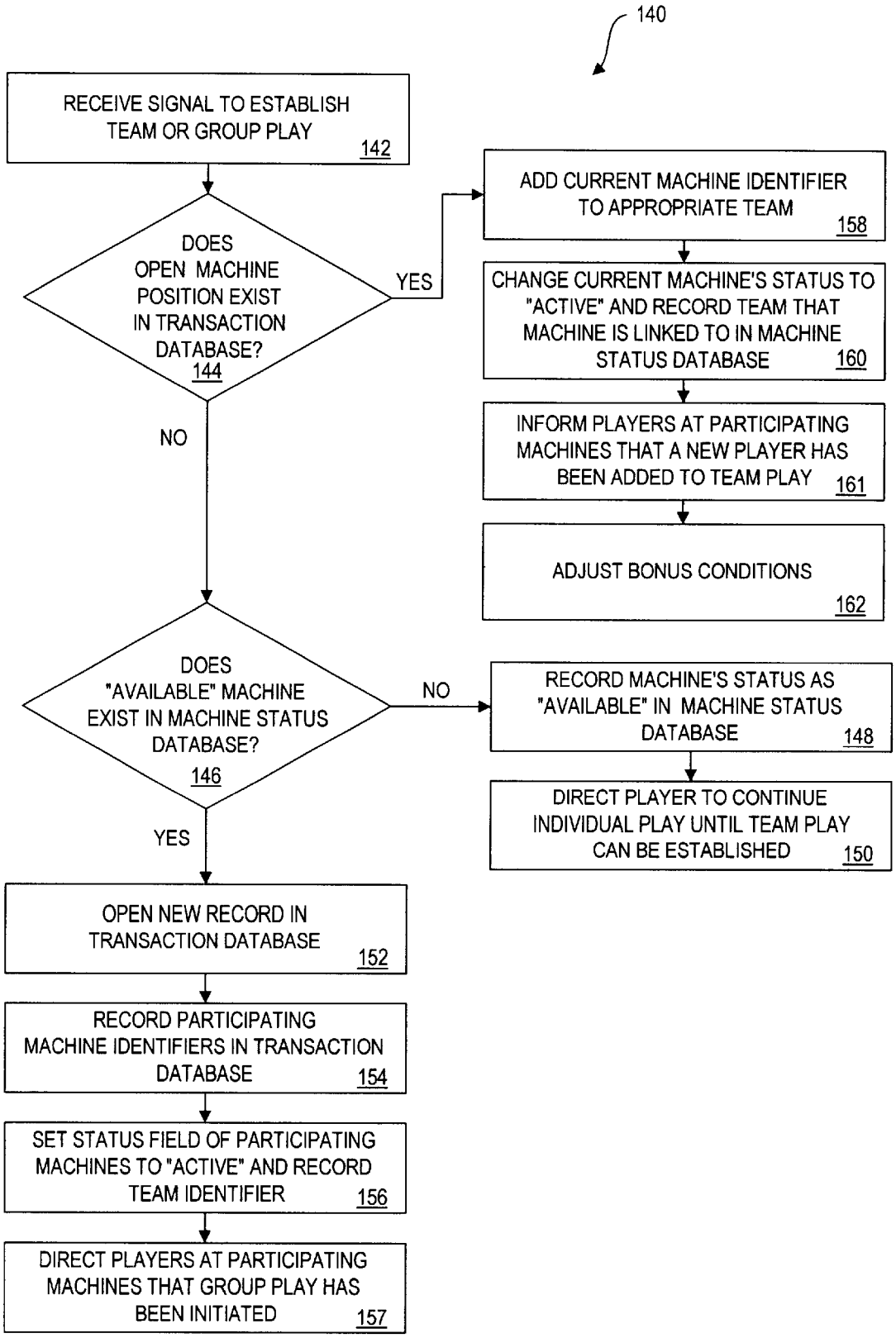
FIG. 9 is a flowchart illustrating a process of linking slot machines for group play.

With reference now to FIG. 9, a process 140 is shown for electronically identifying and linking video poker machines for team play. The process is performed by slot server 18 in the embodiment of FIG. 1, or by one or more programmed video poker machines in the embodiment of FIG. 2. It will be appreciated that video poker machines such as machine 40 of FIG. 4 typically contain a processor and memory, and are programmable to operate in accordance with the present invention.

In the described embodiment of the invention, each new player to video poker machine 40 is provided the option to engage in group play by pressing "JOIN TEAM PLAY" button 50. Server 18 then operates in accordance with the process set out in FIG. 9 to ad hoc engage the machine in team play. If the machine is not in play, or a player actively chooses not to engage in team play, the status in machine status database 80 indicates "unavailable." As described below, if a player chooses to engage in team play, but a team is not available, the status in machine status database indicates "available." If the machine is engaged in team play, its status is reflected in the machine status database as "active."

In the alternate embodiment of the invention wherein machines are pre-selected for team play, a machine is pre-set to play in a selected group. It remains a group play machine in that pre-selected group until it is is reset by the server pursuant, for example, to a time-out condition. In this alternate embodiment, the status of the machine is reflected in the transaction database as described above.

Process 140 is initiated by the receipt of a signal from video poker machine 40 requesting the establishment of team play (step 142). Such a signal is generated by, for example, player operation of "JOIN TEAM PLAY" button 50 (FIG. 5). The signal would include the machine identifier as described above. In an alternate embodiment, the signal would include an identifier of the team that the player wishes to join. Team information would be provided to a player, for example, by displaying a list of teams having positions open for additional players, including active team players (if such player information is available). A player may also be provided with a search capability to search stored team data to identify teams having particular members. In yet another embodiment, a player is provided with the opportunity to select between teams playing in accordance with different bonus conditions. A signal indicating a selected team may be received from the player via a conventional input device such as a keypad or touchscreen.

Upon receiving the request to join team play, slot server 18 functions to access transaction database 110 to determine if an open machine position exists in any of the established teams (step 144). If no machine position is open in an established team, slot server 18 functions to access machine status database 80 to determine if any available machines are indicated therein (step 146). If no positions exist in established teams, and no machines are available to form new teams, then the requesting video poker machine is identified as "available" in the machine status database (step 148). A message is transmitted to the machine for display to the player indicating that team play is not available, and the player should continue individual play until the requisite number of other machines are available to form a team, or a position becomes open within an established team (step 150).

If, upon checking for other available machines in step 146 such an available machine is found, then a new record is opened in transaction database 110 (step 152), a new team identifier is generated by the server to track the new record, and the participating machine identifiers are recorded therein (step 154). That is, the initial requester and the found available machine are linked to form a new team. The status of these participating machines in the newly formed team is set to "active" (step 156) in machine status database 80. If the minimum requisite number of players as defined by the bonus conditions are available for team play, the players are informed that they have engaged in group play through the transmission and display of an appropriate team play message (step 157). Otherwise, the team entry is established in the transaction database, but team play is not established and players are not notified until the requisite number of machines are networked for that team. As will be appreciated, based on the illustrated bonus conditions set out in bonus payout database 90 (FIG. 7), at least four machines are necessary to establish team play in the described embodiment; that is, a minimum of four machines are necessary to be eligible for the three four-of-a-kind bonus.

If, upon checking for an open position in step 144 such an open position is found, then the current machine identifier is added to the appropriate team in transaction database 110 (step 158). In machine status database 80, the machine status is changed to "active," and the team identifier with which the machine is linked is entered into the team field (step 160). Appropriate signals are transmitted to the players participating in the team that a new team player has been added (step 161). As is necessary depending on the bonus conditions defined for team play, the bonus conditions are updated to reflect the changed number of players, and transmitted for display to the various team machines (step 162).

In one embodiment, the messages to the various team players contain information identifying the other linked team players so that they may identify one-another. Such information can comprise, for example, displayed machine numbers for the grouped machines, the machine numbers displayed in a selected graphical display area on each machine. In another embodiment, where players are identified to server 18 through the use of a player slot card, the players names may be transmitted and displayed on each of the linked, team play machines.

To complete this process for establishing slot machine teams, slot server 18 establishes network communications amongst the linked machines via communications channel 19, and team play is thus enabled. A detailed description of team play is set out below with reference to FIG. 11.

Figure 10:
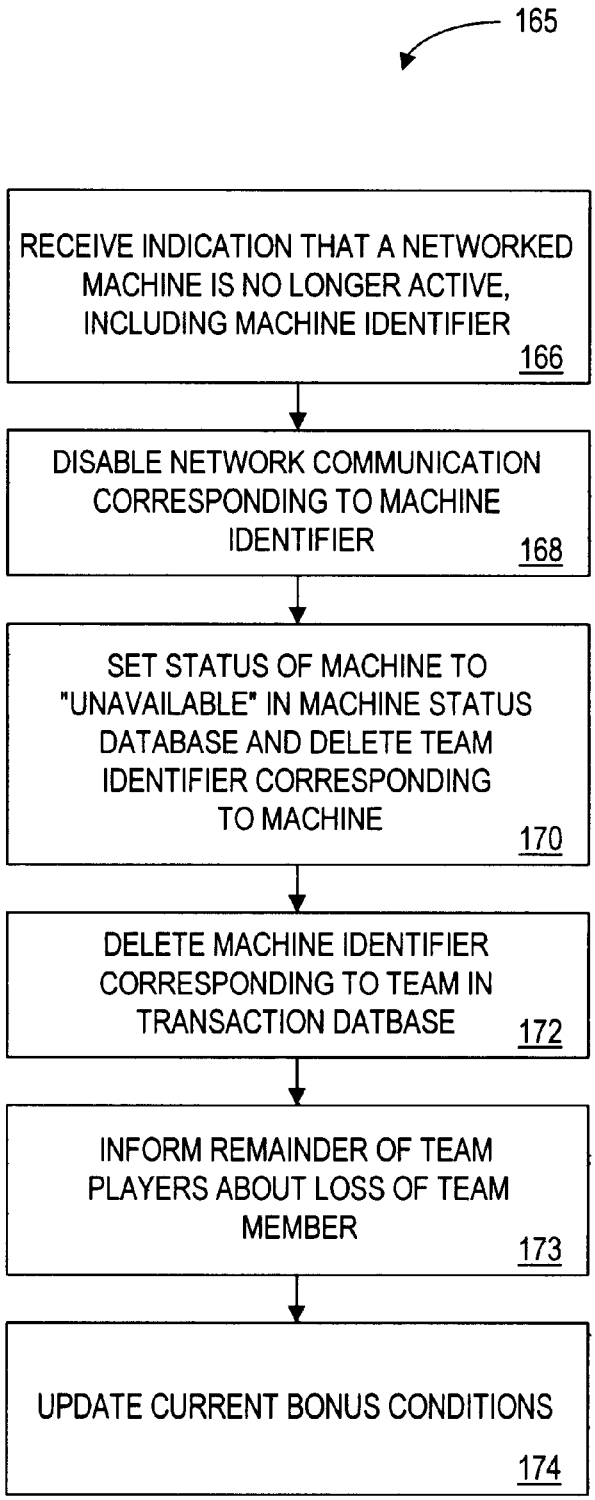
FIG. 10 is a flowchart illustrating a process of removing a networked slot machine from group play.

Referring now to FIG. 10, a process 165 is shown whereby a slot machine is removed from team play. Such a process may be initiated by the occurrence of several different conditions, including: cessation of play by a player; a pre-determined time of inactivity at a machine; a signal provided by a player requesting termination of team play; and/or termination of team play by other team players such that a requisite number of team players becomes unavailable. In the embodiment where machines are pre-linked for team play, a specific time of day may be provided at which the machine is preset to initiate and/or terminate team play. Other conditions upon which it is desirable to initiate and/or terminate team play will now be obvious to those of ordinary skill in the art.

Upon initiating a process to terminate team play, the video poker machine sends a signal to slot server 18 indicating that it is no longer in active play (step 166). The server then functions to disable network communication for that inactive machine (step 168), set the status of the machine in the machines status database to "unavailable," and delete the team identifier from the corresponding field in that same database (step 170). The machine identifier is deleted from the appropriate team record in transaction database 110, with that machine position then showing as "open" in that database (step 172). The remaining players are informed through an appropriate transmission and display of data that the team includes one less player (step 173). If the change in the number of team players results in a change in the bonus conditions as shown in bonus payout database 90 (FIG. 7), the changed bonus conditions are transmitted to the various networked machines for appropriate display.

It will be understood that, should enough players on a team terminate team play, the remaining number of team players may be insufficient to satisfy any team bonus conditions. Under such circumstances, the server will notify the remaining players that team play is not currently available, and initiate the team formation process described above. This will result in either the adding of available new players to the team, or the joining of the newly available team players to other established teams.

In the embodiment of the invention wherein machines are pre-selected for team play, machines are added and/or dropped from team play only as players engage or disengage play on the pre-selected machines. No ad hoc teams are formed. Bonus conditions are adjusted as necessary to reflect changes in players.

Figure 11A:
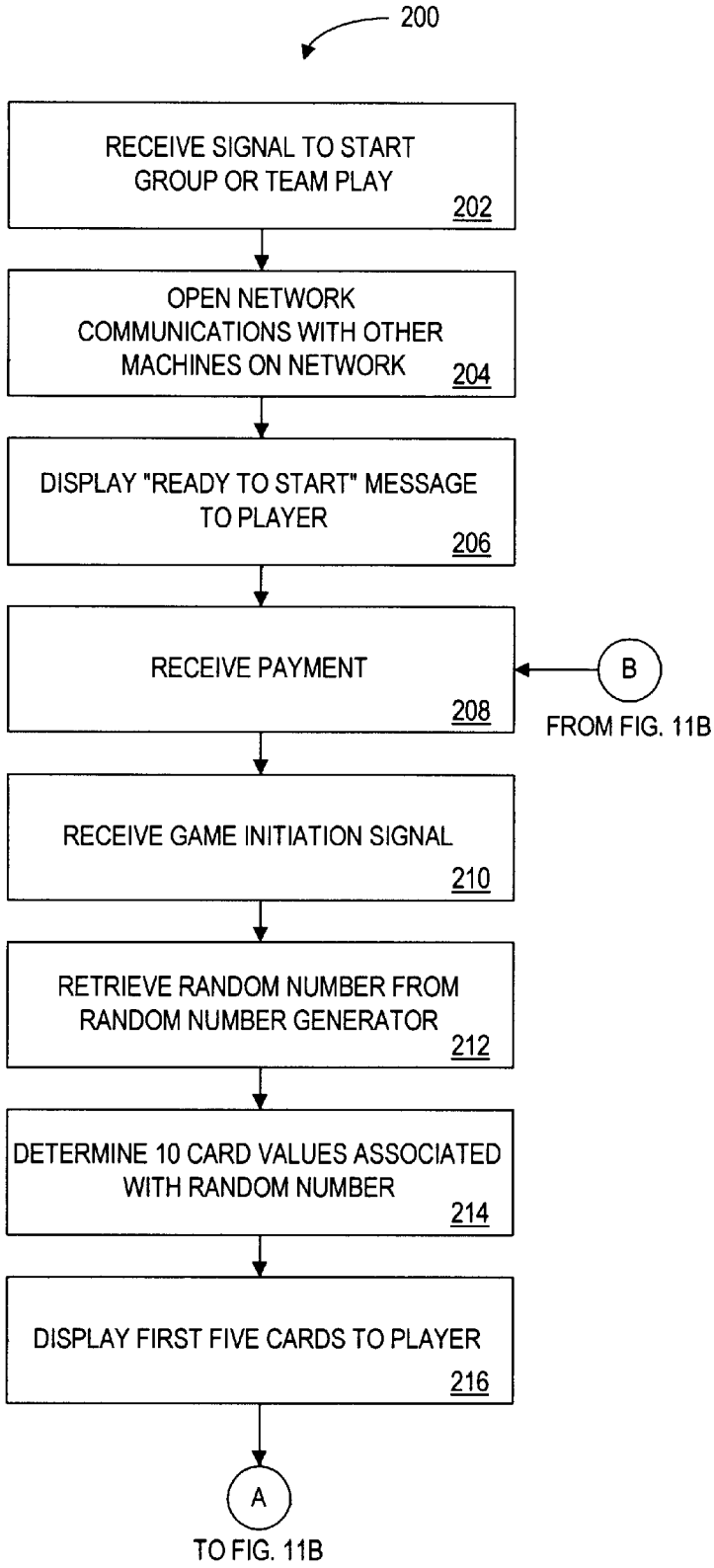
FIGS. 11A–C together comprise a flow chart illustrating a process of group play of video poker machines in accordance with an embodiment of the invention.
Figure 11B:
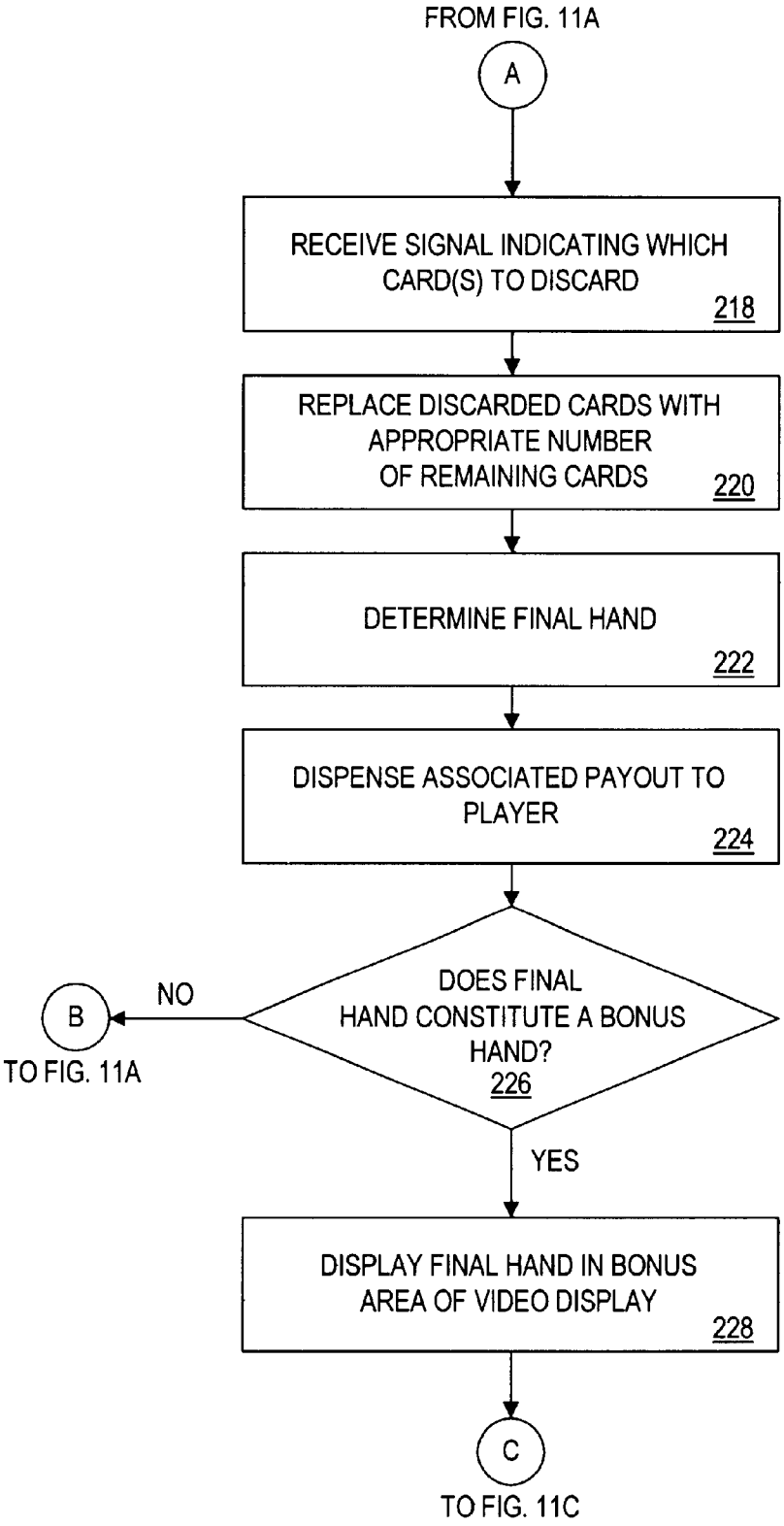
Figure 11C:
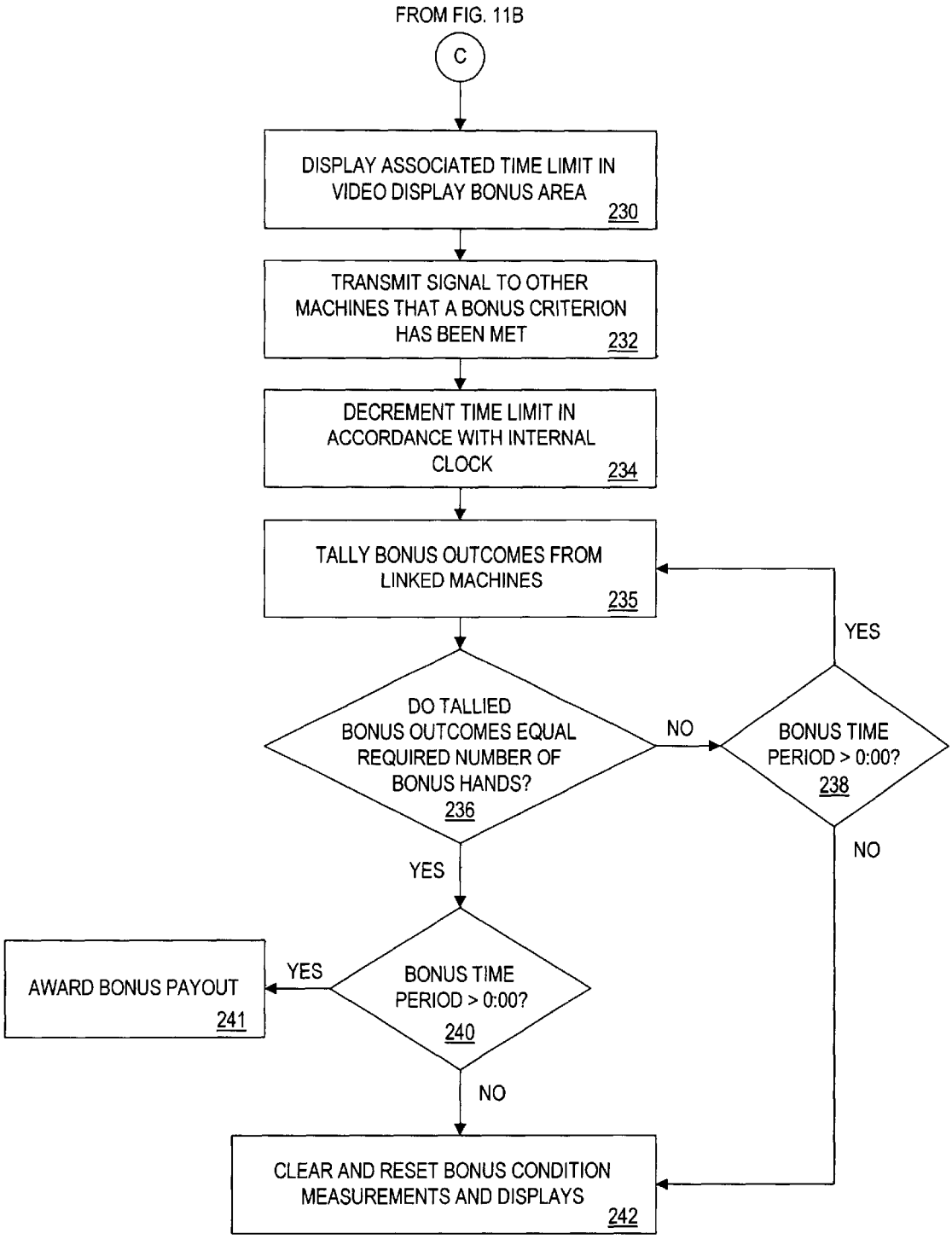

Referring now to FIGS. 11A–C, there is shown a process 200 for the playing of team video poker on a video poker machine in accordance with the present invention. To initiate the process, a player of video poker machine 40 (FIGS. 4 and 5) presses button 50 to transmit to the video poker machine and subsequently to slot server 18 (FIG. 3) a signal to begin team play (step 202). Video poker machine 40 then opens communications with the multiple networked video poker machines (step 204) identified for team play, the team machines having been established with respect to FIG. 9 above. Subsequent to the linking of the machines to enable team play, an indicator is provided to the player that the machine is enabled for team play (step 206). Such an indication may be, for example, by the display of a "ready to start" message on the video display of the machine, or by changing the color of the "join team play" button.

Payment is received from the player (step 208), followed by a game initiation signal (step 210) upon the player's operation of "start" button 46. Video poker machine 40 retrieves a random number from random number generator 58 (step 212), and processes the random number to select ten playing card values (step 214). The first five cards are then electronically 'dealt' to the player by display in areas 54A–E on display screen 54 (step 216).

With reference now to FIG. 11B, the video poker machine receives from the player signals indicating which card(s) the player chooses to hold (and thus which cards are to be discarded) (step 218). Such signals are generated by the player operation of buttons 55A–F in a conventional manner.

Once identified, the discarded cards are replaced with an appropriate number of the remaining cards from the originally selected ten cards (step 220) to determine the final hand (step 222). A payout is dispensed to the player in accordance with the rank of the final hand (step 224). The value of this payout is determined in a conventional manner, typically using the payout table as described above.

In accordance with the present invention, the video poker machine then enters into a bonus mode of operation wherein a test is performed to determine if the most recent final hand matches any of the bonus hands from field 96 of bonus payout database 90 (FIG. 7) (step 226). In the present example, as described above with respect to the bonus payout database, bonus hands are defined as royal flushes, four-of-a-kinds, or regular flushes. If no bonus hand is detected, i.e. no flush or four-of-a-kind, then repeat play continues with step 208. If a royal flush, a regular flush, or a four-of-a-kind is detected, then it is indicated as a "bonus hand obtained" in bonus display area 54F of video display 54 (step 228).

It will be appreciated that, pursuant to the discussion above, in alternate embodiments the payouts resulting from meeting the bonus conditions may vary depending on the number of machines engaged in team play. For example, if two players are engaged in team play, the payouts may be lower than the payouts provided for a team of five players. Alternatively, the required number and/or rank of bonus hand(s) may be changed depending on the number of players.

Continuing with reference to FIG. 11C, once a bonus hand is identified, the system clock (FIG. 4) is initiated for the periods of time set out in field 98 of bonus payout database 90: i.e. one hundred and twenty seconds to obtain two royal flushes, 30 seconds to obtain three four-of-a-kinds, and 60 seconds to obtain five regular flushes. The bonus time period is displayed in the "time remaining" portion of bonus display area 54F (step 230). Substantially simultaneously, to establish team play, the bonus information identifying the bonus hand and the bonus time period are transmitted to the linked, team machines (step 232) for display in the bonus display area. The bonus time period is then decremented in a 'count down' manner (step 234), with the countdown being displayed on each of the linked machines.

As the bonus time period counts down, bonus outcomes that occur on all of the linked machines are collected and totalled, the total being displayed on all of the linked machines in the bonus display area (step 235). If a bonus outcome occurs during the bonus time period, it is tested to determine if it completes the required number of bonus outcomes as defined in field 97 of bonus payout database 90 (FIG. 7) (step 236). If it does not complete a required bonus outcome, then it is determined whether the bonus time period is still active, i.e. has not decremented to zero (step 238). If the bonus time period is still active, the system continues collecting and tallying bonus outcomes per step 235. If the bonus time period has expired, then the bonus display area is cleared until another bonus hand results amongst the team players (step 242).

It will be appreciated that, during the bonus time period, players will be encouraged to play in an interactive, team environment, playing as quickly and effectively as possible to achieve the bonus results. Because the play outcomes of each player contribute to the potential bonus award to all of the players, the players will find themselves participating as a team, where each individual contributes to the good of the whole. This will attract players desiring a team environment. It may even encourage players to sacrifice potentially higher individual outcomes to achieve a team bonus outcome. For example, a player may be tempted to break up a pair or a three-of-a-kind in order to attempt to obtain a required number of bonus hands such as flushes or royal flushes.

If the test at step 236 indicates that the required number of bonus hands have been achieved, then the clock is again tested to determine if the bonus time period is active (step 240). If it is active, then an appropriate bonus payout is made to each team player per payout field 100 of the bonus payout database (step 241). If the bonus period is expired, then as above the bonus display area is cleared until another bonus hand results amongst the team players (step 242).

While the above embodiment of the invention is illustrated with respect to the operation of video poker machines, the invention is equally applicable to other types of slot machines.

With respect to a reel slot machine, in lieu of a video poker outcome, the bonus conditions comprise the obtaining of one or more predefined reel outcomes within the bonus time period. For example, a first bonus condition may comprise the team achieving three "cherry-cherry-cherry" outcomes within a two minute time period, while a second bonus condition may comprise achieving two "bar-bar-anything" outcomes within a one minute period. It will be appreciated that many combinations of bonus conditions and payouts may be selected in a conventional manner based on the likelihood of the results and the desired advantage for the casino.

With respect to bingo machines, in lieu of a video poker outcome or slot reel outcome, bonus conditions may be defined in terms of specific row, column, and/or diagonal bingo results. With respect to keno, bonus conditions may be defined in terms of minimum quantities of player selections matching drawn numbers.

There has thus been provided a new and improved system and method for providing linked, team play options for what have been traditionally stand-alone play slot machines. The invention introduces the concepts of team play and social interaction into such games, with the intended result of increasing the player pool to include those who enjoy such social interactions. The invention has application to all slot machines, including video poker machines, conventional slot machines, bingo machines, and the like. It is applicable to commercial gaming machines and environments, with the result of improving the player experience, increasing the player pool, and increasing the profitability of such games to their owners.

Thus described, numerous other modifications, improvements and variations falling within the scope of the invention will occur to those skilled in the art.

What is claimed is:

1. A member of operation of slot machines, comprising the steps of:

identifying at least two slot machines for team play;

determining a set of bonus conditions for said team play including a bonus payout if said bonus conditions are satisfied by said team play, wherein the bonus conditions are determined based on the number of slot machines for which the bonus conditions apply;

initiating a bonus time period during which said bonus conditions are active;

totaling outcomes from said at least two slot machines to determine if said bonus conditions are met during said bonus time period.

2. The method of claim 1 wherein said set of bonus conditions includes a required number of a bonus outcome; and said step of initiating a bonus time period includes initiating said bonus time period upon the occurrence of a first said bonus outcome on one of said at least two slot machines.

3. A system for controlling the operation of slot machines, comprising:

a processor;

a memory storing a program to operate said processor;

said processor operative with said program to identify at least two slot machines for team play, determine a set of bonus conditions for said team play including a bonus payout if said bonus conditions are satisfied by said team play, wherein the bonus conditions are determined based on the number of slot machines for which the bonus conditions apply, initiate a bonus time period during which said bonus conditions are active, and total outcomes from said at least two slot machines to determine if said bonus conditions are met during said bonus time period.

4. The system of claim 3 wherein said set of bonus conditions includes a required number of a bonus outcome; and said operation of initiating a bonus time period includes initiating said bonus time period upon the occurrence of a first said bonus outcome on one of said at least two slot machines.

5. A method of operation of slot machines, comprising the steps of:

identifying at least a first and a second slot machine;

determining a set of bonus conditions including a bonus time period, a required number of a bonus outcome, and a bonus payout to be paid if said required number of said bonus outcome results from the combined play of each of said first and second slot machines within said bonus time period, wherein the bonus conditions are determined based on the number of slot machines for which the bonus conditions apply;

initiating, when a play of said first slot machine results in said bonus outcome, said bonus time period;

signaling said second slot machine that said bonus time period has been initiated; and monitoring outcomes on said first and second slot machines to determine if said required number of said bonus outcome results from the combined play of said first and second slot machines during said bonus time period.

6. The method of claim 5 wherein said step of identifying at least a first and a second slot machine includes receiving a signal from each of said first and second slot machines indicating the first and second slot machines' availability for group play.

7. The method of claim 5 wherein each of said first and second slot machines comprises a video poker machine.

8. The method of claim 7 wherein said bonus outcome comprises a selected rank of video poker hands.

9. The method of claim 5 wherein each of said first and second slot machines comprises a reeled slot machine.

10. The method of claim 9 wherein said bonus outcome comprises a selected combination of reel symbols.

11. The method of claim 5 wherein said monitoring step includes totaling said bonus outcome on each of said first and second slot machines during said bonus time period to determine if said required number of said bonus outcome is met.

12. The method of claim 5 and further including the step of identifying at least a third slot machine for operation with said first and second slot machines.

13. The method of claim 12 and further including the step of removing said third slot machine from operation with said first and second slot machines.

14. The method of claim 5 and further including the step of providing said bonus payout on said first and second slot machines if said monitoring step determines that said required number of said bonus outcome results from the combined play of said first and second slot machines.

15. The method of claim 14 wherein said step of providing said bonus payout includes providing an equal payout on each of said first and second slot machines.

16. The method of claim 14 wherein said step of providing said bonus payout includes providing a different payout on each of said first and second slot machines.

17. The method of claim 16 wherein the value of said different payout is determined by the number of bonus outcomes obtained by the slot machine on which said bonus payout is being paid.

18. A system for controlling the operation of slot machines, comprising:

a processor;

a memory connected to said processor and including a program for controlling the operation of said processor;

said processor operative with said program in said memory to identify at least a first and a second slot machine, determine a set of bonus conditions including a bonus time period, a required number of a bonus outcome, and a bonus payout to be paid if said required number of said bonus outcome results from the combined play of each of said first and second slot machines within said bonus time period, wherein the bonus conditions are determined based on the number of slot machines for which the bonus conditions apply, initiate, when a play of said first slot machine results in said bonus outcome, said bonus time period, signal said second slot machine that said bonus time period has been initiated, and monitor outcomes on said first and second slot machines to determine if said required number of said bonus outcome results from the combined play of said first and second slot machines during said bonus time period.

19. The system of claim 18 wherein said operation of identifying at least a first and a second slot machine includes receiving a signal from each of said first and second slot machines indicating the first and second slot machines' availability for group play.

20. The system of claim 18 wherein each of said first and second slot machines comprises a video poker machine.

21. The system of claim 20 wherein said bonus outcome comprises a selected rank of video poker hands.

22. The system of claim 18 wherein each of said first and second slot machines comprises a reeled slot machine.

23. The system of claim 22 wherein said bonus outcome comprises a selected combination of reel symbols.

24. The system of claim 18 wherein said operation of monitoring includes totaling said bonus outcomes on each of said first and second slot machines during said bonus time period to determine if said required number of said bonus outcome is met.

25. The system of claim 18 wherein said processor is further operative to identify at least a third slot machine for operation with said first and second slot machines.

26. The system of claim 25 wherein said processor is further operative to remove said third slot machine from operation with said first and second slot machines.

27. The system of claim 18 wherein said processor is further operative to provide said bonus payout on said first and second slot machines if said monitoring step determines that said required number of said bonus outcome results from the combined play of said first and second slot machines.

28. The system of claim 27 wherein said operation of providing said bonus payout includes providing an equal payout on each of said first and second slot machines.

29. The system of claim 27 wherein said operation of providing said bonus payout includes providing a different payout on each of said first and second slot machines.

30. The system of claim 29 wherein the value of said different payout is determined by the number of bonus outcomes obtained by the slot machine on which said bonus payout is being paid.

31. A system for operating slot machines, comprising:

means for identifying at least a first and a second slot machine;

means for determining a set of bonus conditions including a bonus time period, a required number of a bonus outcome, and a bonus payout to be paid if said required number of said bonus outcome results from the combined play of each of said first and second slot machines within said bonus time period, wherein the bonus conditions are determined based on the number of slot machines for which the bonus conditions apply;

means for initiating, when a play of said first slot machine results in said bonus outcome, said bonus time period;

means for signaling said second slot machine that said bonus time period has been initiated; and means for monitoring outcomes on said first and second slot machines to determine if said required number of said bonus outcome results from the combined play of said first and second slot machines during said bonus time period.

32. A program product including instructions recorded on a computer-readable medium operative to control a computer to operate slot machines, comprising:

said instructions operative to control said computer to identify at least a first and a second slot machine;

determine a set of bonus conditions including a bonus time period, a required number of a bonus outcome, and a bonus payout to be paid if said required number of said bonus outcome results from the combined play of each of said first and second slot machines within said bonus time period, wherein the bonus conditions are determined based on the number of slot machines for which the bonus conditions apply;

initiate, when a play of said first slot machine results in said bonus outcome, said bonus time period;

signal said second slot machine that said bonus time period has been initiated; and monitor outcomes on said first and second slot machines to determine if said required number of said bonus outcome results from the combined play of said first and second slot machines during said bonus time period.

33. A method of operation a slot machine, comprising the steps of:

identifying at least a second slot machine for group play;

determining a set of bonus conditions including a required quantity of a bonus outcome, a bonus time period, and a bonus payout, wherein the bonus conditions are determined based on the number of slot machines for which the bonus conditions apply;

initiating a play resulting in said bonus outcome;

starting said bonus time period substantially upon the occurrence of said bonus outcome; and transmitting to said second slot machine a signal that said bonus time period is started.

34. A method in accordance with claim 33 and further including the step of receiving from said second slot machine a signal indicating the occurrence of said bonus outcome on said second slot machine during said bonus time period.

35. A method in accordance with claim 33 wherein each of said slot machines comprises a video poker machine, and said bonus outcome comprises a selected rank of video poker hands.

36. A method in accordance with claim 33 wherein each of said slot machines comprises a reeled slot machine, and said bonus outcome comprises a selected reel outcome.

37. A slot machine, comprising:

a processor;

a memory connected to said processor and storing a program for controlling the operation of said processor;

said processor operative with said program in said memory to identify at least a second slot machine for group play, determine a set of bonus conditions including a required quantity of a bonus outcome, a bonus time period, and a bonus payout, wherein the bonus conditions are determined based on the number of slot machines for which the bonus conditions apply, initiate a play resulting in said bonus outcome, start said bonus time period substantially upon the occurrence of said bonus outcome, and transmit to said second slot machine a signal that said bonus time period is started.

38. A slot machine, comprising:

means for identifying at least a second slot machine for group play;

means for determining a set of bonus conditions including a required quantity of a bonus outcome, a bonus time period, and a bonus payout, wherein the bonus conditions are determined based on the number of slot machines for which the bonus conditions apply;

means for initiating a play resulting in said bonus outcome;

means for starting said bonus time period substantially upon the occurrence of said bonus outcome; and means for transmitting to said second slot machine a signal that said bonus time period is started.

39. A method of operation of a slot machine, comprising the steps of:

identifying at least a second slot machine;

determining a set of bonus conditions including a required quantity of a bonus outcome, a bonus time period, and a bonus payout, wherein the bonus conditions are determined based on the number of slot machines for which the bonus conditions apply;

receiving a signal from said second slot machine indicating that a play of said second slot machine has resulted in a bonus outcome activating said bonus time period;

generating, responsive to plays, at least one outcome during said bonus time period; and analyzing said at least one outcome to determine if said at least one outcome comprises said bonus outcome.

40. A method in accordance with claim 39 and further comprising the step of transmitting to said second slot machine a signal indicating the occurrence of said bonus outcome during said bonus time period.

41. A method in accordance with claim 39 wherein each of said slot machines comprises a video poker machine, and said bonus outcome comprises a selected rank of video poker hands.

42. A method in accordance with claim 39 wherein each of said slot machines comprises a reeled slot machine, and said bonus outcome comprises a selected reel outcome.

43. A slot machine, comprising:

a processor;

a memory connected to said processor and storing a program for controlling the operation of said processor;

said processor operative with said program in said memory to identify at least a second slot machine, determine a set of bonus conditions including a required quantity of a bonus outcome, a bonus time period, and a bonus payout, wherein the bonus conditions are determined based on the number of slot machines for which the bonus conditions apply, receive a signal from said second slot machine indicating that a play of said second slot machine has resulted in a bonus outcome activating said bonus time period, generate, responsive to plays, at least one outcome during said bonus time period, and test said at least one outcome to determine if said at least one outcome comprises said bonus outcome.

44. A slot machine, comprising:

means for identifying at least a second slot machine;

means for determining a set of bonus conditions including a required quantity of a bonus outcome, a bonus time period, and a bonus payout, wherein the bonus conditions are determined based on the number of slot machines for which the bonus conditions apply;

means for receiving a signal from said second slot machine indicating that a play of said second slot machine has resulted in a bonus outcome activating said bonus time period;

means for generating, responsive to plays, at least one outcome during said bonus time period; and means for testing said at least one outcome to determine if said at least one outcome comprises said bonus outcome.

45. A method comprising:

identifying a first number of slot machines comprising a team;

determining a first set of bonus conditions based on the first number of slot machines, wherein the first set of bonus conditions applies to the team;

determining that the first number of slot machines has changed to a second number of slot machines that is different from the first number;

adjusting the first set of bonus conditions based on the second number, thereby determining a second set of bonus conditions that applies to the team.

46. The method of claim 45, further comprising:

causing to be displayed the first set of bonus conditions on the slot machines comprising the first number of slot machines; and causing to be displayed the second set of bonus conditions on the slot machines comprising the second number of slot machines, after the step of adjusting.

47. The method of claim 45, wherein at least one of the set of bonus conditions comprises a time period within which at least one outcome of the slot machine has to be obtained by the team.

48. The method of claim 45, wherein at least one of the set of bonus conditions comprises a number of at least one outcome of the slot machines that must be obtained by the team.

49. The method of claim 45, further comprising:

determining a minimum number of slot machines that can comprise a team;

determining that the second number of slot machines is less than the minimum number; and causing a disqualification of the team from eligibility for the set of bonus conditions.

* * * * *